United States Patent [19]

Sasgen

[11] 4,044,424

[45] Aug. 30, 1977

[54] DOOR STOP

[76] Inventor: Anthony M. Sasgen, 1S 174 Ingersoll Lane, Villa Park, Ill. 60181

[21] Appl. No.: 678,914

[22] Filed: Apr. 21, 1976

[51] Int. Cl.[2] ..... E05C 17/54

[52] U.S. Cl. ..... 16/85; 292/343

[58] Field of Search ..... 16/85, 82, 86 A; 292/343, 342, DIG. 15

[56] References Cited

U.S. PATENT DOCUMENTS

| | | | |
|---|---|---|---|
| 918,625 | 4/1909 | Wilkinson | 292/343 UX |
| 1,064,760 | 6/1913 | Nielsen | 292/343 UX |
| 1,197,769 | 9/1916 | Shane | 16/86 A |
| 2,507,967 | 5/1950 | Forester | 292/343 |
| 2,784,443 | 3/1957 | Von Berg | 292/342 X |
| D. 74,361 | 2/1928 | Doggett | 292/343 UX |

*Primary Examiner*—Andrew V. Kundrat

*Attorney, Agent, or Firm*—Kinzer, Plyer, Dorn & McEachran

[57] ABSTRACT

A one-piece door stop of spring metal having a flat vertical flange and a horizontal leg with a spring bow therein insertable in the clearance space between the door and floor.

3 Claims, 4 Drawing Figures

DOOR STOP

This invention relates to a door stop.

The door stop of the present invention will be inserted between the floor surface and lower surface of the door, holding the door by spring pressure. The primary object of the present invention is to construct a door stop of one-piece spring metal, having a bow or arc which exerts a spring force in holding position, so dimensioned and configured as to protrude the least and having no sharp edges likely to scar the floor surface. Another object of the invention is to configure the stop so it will present a generous surface capable of bearing a decorative decal or even a lithographed design. In the drawing:

Figure 1:
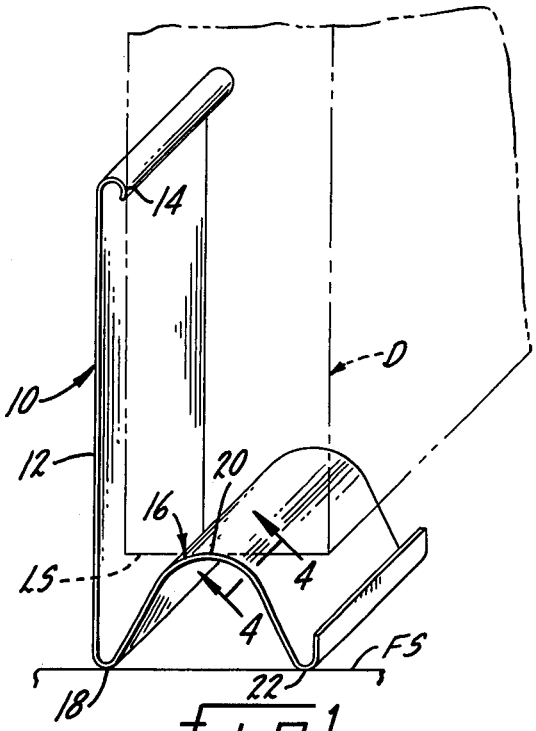
FIG. 1 is a perspective view of the door stop.
Figure 2:
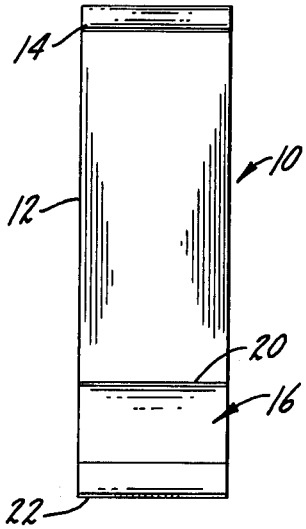
FIG. 2 is a rear elevation.
Figure 3:
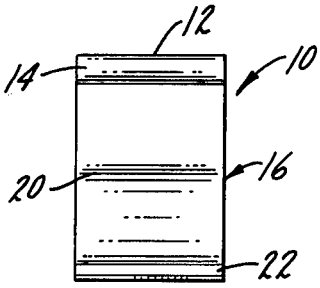
FIG. 3 is a front elevation.
Figure 4:
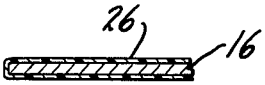
FIG. 4 is a sectional view on the line 4—4 of FIG. 1.

The door stop 10 is essentially of one-piece construction, twenty gauge spring steel, to be inserted between the floor surface and the lower surface LS of the door D.

The stop includes a vertical flange 12, rectangular in outline, having an upper edge terminating in a downwardly rolled bead 14. The leg 12, specifically the bead 14, is adapted to bear against one side of the door.

The stop has a lower leg 16, integral with the flange 12 and joined thereto at an upwardly concave bend 18.

Leg 16 is upwardly convex at 20, to define a spring bow, and extends rearwardly, terminating in an upwardly rolled bead 22. The convex portion 20 is adapted to bear with spring force against the underside of the door.

The span of leg 16 between the bend 18 and bead 22 is approximately $1\frac{3}{4}$ to $1\frac{1}{2}$, corresponding closely to the thickness of a standard wood door, so that there are no protruding parts likely to trip a person.

The radius of the leg is about eleven-sixteenths to three-fourths inch, deemed sufficient to exert a holding force in the instance of a three-fourths inch clearance (or less) at the bottom of the door. More or less radius may be imparted.

The flat vertical flange 12 is about an inch or so in width, and being about three inches or so high affords a generous surface for a decorator pattern, decal, painted, printed or otherwise applied to the outer or visible side thereof.

The door stop is of the same width and cross-section thickness throughout.

Preferably the underside of the leg 16, especially at the bend 18 and bead 22, is coated with a soft plastic or rubber (elastomer) 26 to take a firm grip in the instance of a slick floor surface, or one of concrete.

The rolled beads 14 and 22 prevent the possibility of the door surface, opposed to bead 14, and the floor surface (if uncarpeted) opposed to the bead 22, being marred by shap edges.

If preferred, the flat strip from which the door stop is made by bending, may be covered with a "boot" or sock of the elastomer 26, thereby covering the whole stop instead of merely the leg 16. In such event, the boot or sock may be molded with a decorator face.

I claim:

1. A one-piece door stop of metal comprising a flat vertical flange adapted to bear against one side of the door and an upwardly convex leg integral with the lower end of said flange and joined thereto by a bend and, in which the free end of the flange and leg are each defined by a bent-over head extending the width thereof.

2. A door stop according to claim 1 in which at least the bend and said leg are coated with an elastomer.

3. A door stop according to claim 2 having a design on the visible side of the flange.

* * * * *